US006561598B2

(12) United States Patent
Granger

(10) Patent No.: US 6,561,598 B2
(45) Date of Patent: May 13, 2003

(54) LOADING DEVICE FOR WIPE MATERIAL DISPENSING MACHINE

(76) Inventor: Maurice Granger, 17 Rue Marcel Pagnol, Saint Priest En Jarez (FR), 42270

( * ) Notice: Subject to any disclaimer, the term of this patent is extended or adjusted under 35 U.S.C. 154(b) by 0 days.

(21) Appl. No.: 09/880,337

(22) Filed: Jun. 13, 2001

(65) Prior Publication Data

US 2002/0005685 A1 Jan. 17, 2002

(30) Foreign Application Priority Data

Jun. 14, 2000 (FR) ..... 00 07554

(51) Int. Cl.[7] ..... B65H 61/00
(52) U.S. Cl. ..... 312/34.8
(58) Field of Search ..... 312/34.1, 34.8, 312/34.9, 34.11, 34.16, 34.17

(56) References Cited

U.S. PATENT DOCUMENTS 1,016,270 A * 2/1912 Johnson ..... 312/34.8 X
2,255,609 A * 9/1941 Birr et al. ..... 312/34.11
2,273,384 A * 2/1942 Steiner et al. ..... 312/34.8 X
6,363,824 B1 * 4/2002 Granger ..... 83/334

FOREIGN PATENT DOCUMENTS

| | | | |
|---|---|---|---|
| DE | 14 61 750 B | 9/1970 | |
| FR | 2 771 620 A | 6/1999 | |
| GB | 1010198 | * 11/1965 | ..... 312/34.8 |

* cited by examiner

*Primary Examiner*—James O. Hansen
(74) *Attorney, Agent, or Firm*—Heslin Rothenberg Farley & Mesiti P.C.

(57) ABSTRACT

This loading device is distinctive in that it comprises a flap (5) to protect drum (2) that is mounted so that its angular swivelling on end shields **(1*c*) of the housing is limited so that it is moved away from the drum when cover (8) of the machine is opened in order to make it easier to place the material in front of pressure roller (4) and drum (2) and is automatically moved towards the drum when the cover is closed, said flap being internally designed with a protuberance (5*c*) capable of inserting and securing the material between the pressure roller and the drum; the machine is put into service, i.e. with a strip of material emerging from underneath the machine, by rotating the drum by using an operating knob (9) linked to the drum or an indexed wheel (10) connected to the drum by a transmission system (11)**.

4 Claims, 3 Drawing Sheets

LOADING DEVICE FOR WIPE MATERIAL DISPENSING MACHINE

CROSS REFERENCE TO RELATED APPLICATIONS

This application claims the priority of French application FR 00.07554 filed Jun. 14, 2000. The entire disclosure is incorporated herein by reference.

The object of the invention relates to the technical field of sanitation dispensing machines, especially for hand wipes.

The Applicant has developed dispensing machines for wipe materials such as paper, absorbent paper and, in particular, machines in which a predetermined length of material presented in reel form is simultaneously uncoiled and cut when the user manually pulls on a strip of material that emerges from underneath the machine when it is in the idle state.

To achieve this, the machine comprises a drum rotatably mounted between end shields joined to a wall-mounted housing and including a cutting device designed to be ejected from the drum and penetrate into the material as it rotates on a reel holder and is wound over the drum and tensioned between the point where it is pulled and a pressure roller that is also rotatably mounted on the end shields as the drum rotates and is moved without slipping relative to the material. At the end of pulling, the cutting device separates the material automatically and, through the action of means of storing energy, the drum returns to its idle position after being stopped by a non-return limit stop means, and a new strip of material emerges from underneath the machine which is then ready to dispense more material.

When the reel of material needs to be replaced, the person tasked with loading it places a fresh reel on the reel holder, uncoils the end strip placing it in front of the pressure roller and has to manually insert the end between said pressure roller and the drum and then rotate said drum by using a lateral operating knob directly linked to the drum or an indexed wheel that protrudes underneath the machine and is connected to the drum by a transmission system.

In order to avoid the person tasked with loading the machine having to manually place the material between the pressure roller and the drum, provision has been made, in accordance with the invention, for a simple, effective and ergonomic loading device in the form of a front protection flap for the drum which is mounted on the end shields of the housing so that it can pivot to a limited extent and be moved away from the drum when the cover of the machine is opened in order to make it easier to place the material in front of the pressure roller and the drum, this flap automatically being moved closer to the drum when the cover is closed, said flap being internally designed with a protuberance capable of inserting and securing the material between the pressure roller and the drum; the machine is put into service, i.e. with the strip of material emerging from underneath the machine, by rotating the drum using the operating knob or indexed wheel.

These aspects and others will become apparent from the following description.

The object of the present invention is described, merely by way of example, in the accompanying drawings in which.

Figure 1:
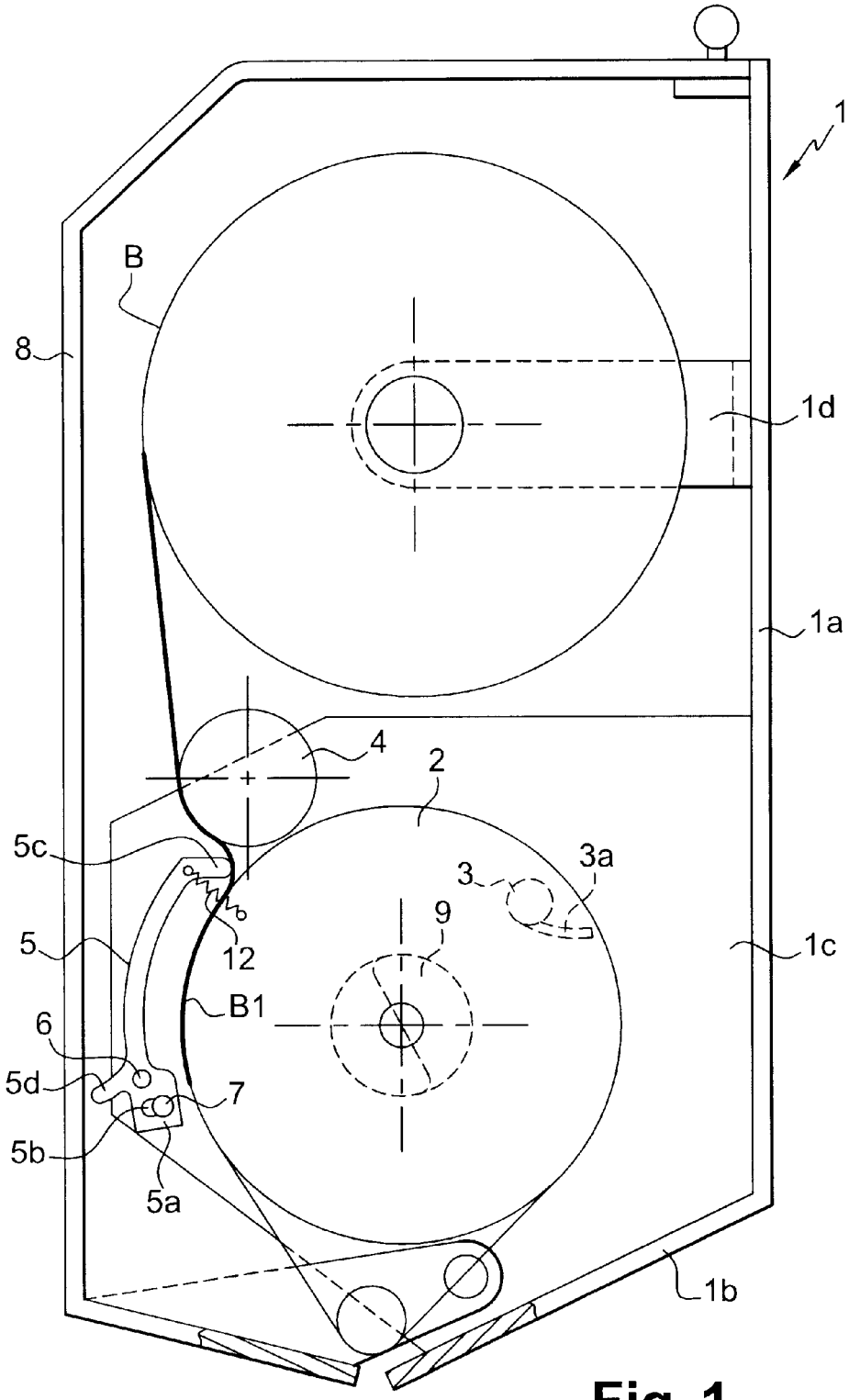
FIG. 1 is a schematic side view of a machine equipped with the device according to the invention shown in its position when the machine is loaded and the cover closed.

In order that the present invention may more readily be understood, the following description is given, merely by way of example, reference being made to the accompanying drawings.

A brief reminder of the main components of the dispensing machine: a wall-mounted housing (1) with a back wall (1*a*) and bottom wall (1*b*) accommodates lateral end shields (1*c*) on which a drum (2) is articulated, this drum has a built-in cutting device (3) with a toothed blade (3*a*) which is associated with means (not shown) that ensure that the blade is ejected out of the drum as the drum rotates due to the manual pulling of a strip (B1) of wipe material emerging from underneath the machine in its idle state, after loading a reel (B) that is rotatably mounted on arms (1*d*) that are joined to rear wall (1*a*).

Between reel (B) and drum (2), a pressure roller (4) is also rotatably mounted on end shields (1*c*) and presses against the drum in order to wind the strip of material which must pass between said pressure roller and the drum before emerging from underneath the machine after having passed behind the drum.

In order to achieve loading a fresh reel into the machine easily, provision has been made, according to the invention, for a device that ensures the strip of material is automatically inserted between pressure roller (4) and drum (2).

To achieve this, a protection flap (5) is located in front of the drum. The lower widened part (5*a*) of this flap is articulated at part (6) on end shields (1*c*) of the housing. Angular swivelling of the flap is limited by the way in which slots (5*b*) cooperate with fixed studs (7) on end shields (1*c*). The upper end of flap (5) has an internal protuberance (5*c*) in its upper part located between pressure roller (4) and drum (2).

Figure 2:
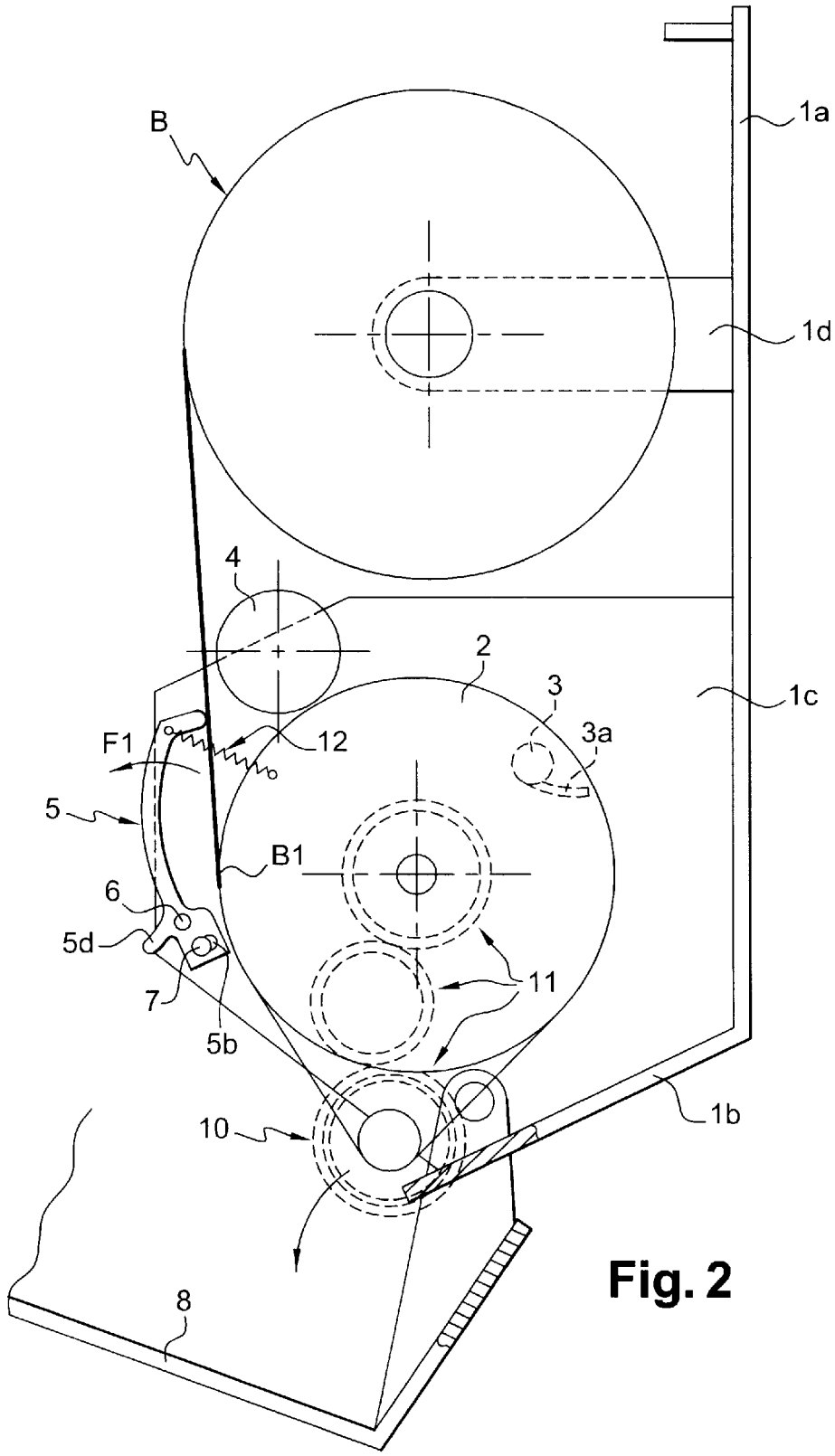
FIG. 2 is a view similar to FIG. 1, the device being shown in its position before the machine is loaded and with the cover open.
Figure 3:
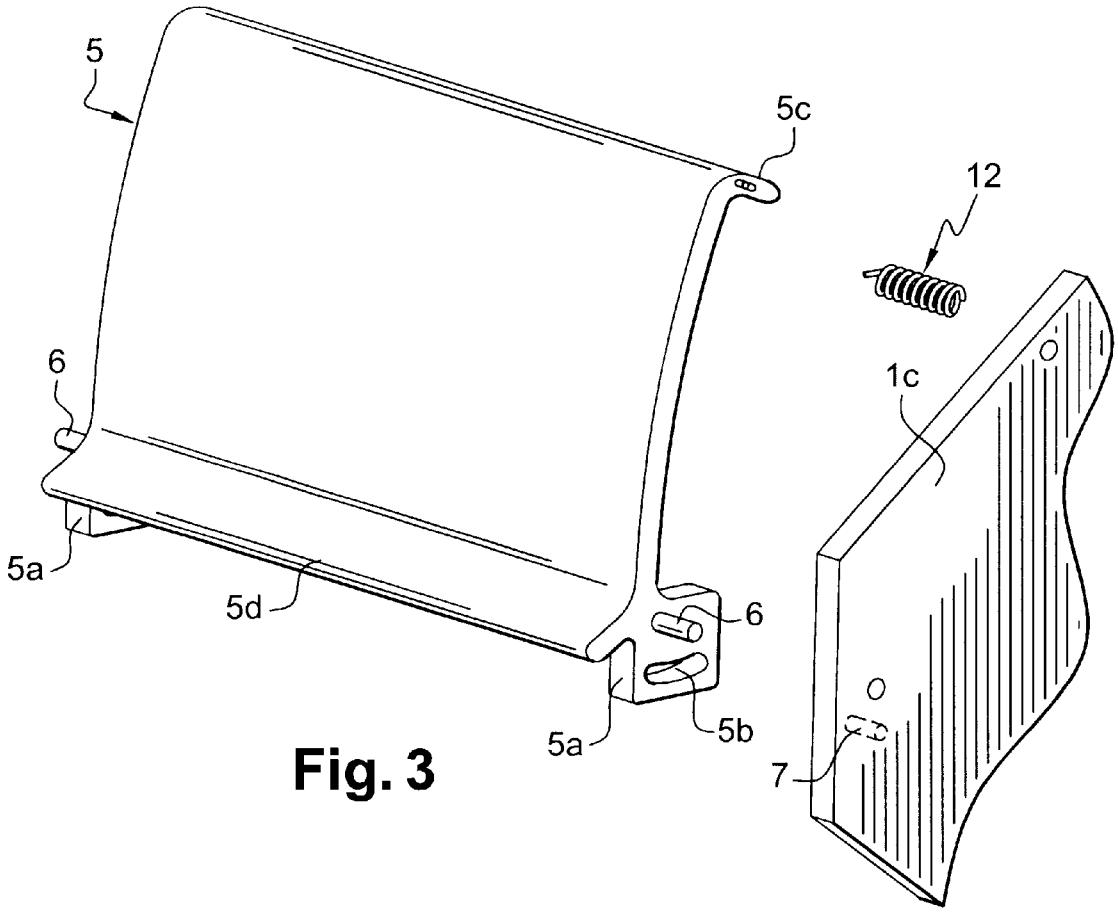
FIG. 3 is a perspective view showing the loading device.

In a first embodiment, flap (5) is positioned so that when the cover (8) of the machine is opened in order to fit a reel (B), said flap swivels due to gravity and moves away from the drum (arrow F1), thereby freeing up the space in front of the pressure roller and the drum. In this position, it is sufficient to insert the strip (B1) into this space (FIG. 2) and to reclose the cover (FIG. 1) in order for the protuberance (5*c*) of the flap to be pushed back by the cover and insert the material between the pressure roller and the drum.

At this stage, automatic loading is completed and all that needs to be done is to make said strip (B1) emerge from underneath the machine. To do this, there are means of moving the drum such as those developed by the Applicant, namely either a lateral operating knob (9) directly linked to the drum (FIG. 1) or an indexed wheel (10) that protrudes underneath the machine and is connected to the drum (FIG. 2) by a transmission system (11).

In another embodiment, the swivelling flap is manually moved away from the drum in order to achieve loading by pressing on a projection (5*d*) at the base of the flap in opposition to return spring (12) that connects the upper end of the flap to end shields (1*c*).

The advantages will be apparent from the description. The simplicity of the device is emphasised, it avoids the person tasked with loading the machine having to perform any manipulation — all they need to do is to place the strip of material in front of the pressure roller and the drum without having to manually insert it between these units.

What is claimed is:

1. Loading device for a wipe material dispensing machine comprising a wall-mounted housing (1), a drum (2) with a built-in cutting device (3), said drum rotatably mounted on end shields (1*c*) of the housing, a reel(B) for holding a wipe material rotatably mounted on arms (1*d*) of the housing, a pressure roller (4) rotatably mounted on said end shields (1*c*) and in contact with said drum (2), the loading device comprising a protection flap (5) of said drum (2) pivotably mounted to limit angular swivelling on said end shields (1*c*) of the housing, said flap moveable away from said drum when a cover (8) is opening in order to position said material in front of said pressure roller (4) and said drum (2) and said flap moveable automatically towards said drum when said cover is closing, said flap further comprising a protuberance (5*c*) for inserting and securing the material between the pressure roller and the drum; wherein the machine is put into service with a strip of material emerging from underneath the machine, by rotating the drum using an operating knob (9) linked to the drum or an indexed wheel (10) connected to the drum by a transmission system (11).

2. The loading device of claim 1 wherein said flap (5) is articulated at part (6) on said end shields (1*c*) of said wall-mounted housing (1) whereby said flap automatically moves away from said drum (2) when said cover (8) is opened in order to place a protruding strip (B1) in front of said pressure roller (4) and said drum (2) and, the flap is pushed back when closing the cover in order to insert the material between the pressure roller and the drum.

3. The loading device of claim 1 wherein said flap (5) is articulated at part (6) on said end shields (1*c*) of said wall-mounted housing (1) and said flap is manually moved away from said drum (2) when opening the cover (8) by pressing on a projection (5*d*) at a base (5*a*) of the flap in opposition to a return spring (12) connecting the upper end of the flap to said end shields (1*c*).

4. The loading device of claim 1 wherein slots (5*b*) formed in a base (5*a*) of said flap cooperate with fixed studs (7) on said end shields (1*c*) whereby swivelling of said flap is limited.

* * * * *